US005746405A

United States Patent [19]

Dvorak et al.

[11] Patent Number: 5,746,405

[45] Date of Patent: May 5, 1998

[54] WATER HEATER SEISMIC SUPPORT SYSTEM

[76] Inventors: John Thomas Dvorak, 19725-A Redwood Rd., Castro Valley, Calif. 94546; Joseph J. Erasmy, 150 Keefe Ct., San Bruno, Calif. 94066

[21] Appl. No.: 386,426

[22] Filed: Feb. 10, 1995

[51] Int. Cl.[6] ..... A47G 23/02

[52] U.S. Cl. ..... 248/146; 248/154

[58] Field of Search ..... 248/146, 148, 248/149, 150, 151, 154, 231.91, 354.3, 351, 188.2, 188.8, 188.9

[56] References Cited

U.S. PATENT DOCUMENTS

| | | | |
|---|---|---|---|
| 834,377 | 10/1906 | Foster . | |
| 839,062 | 12/1906 | Gagnon . | |
| 860,063 | 7/1907 | Sanders . | |
| 979,123 | 12/1910 | Bohrer | 248/151 |
| 1,392,486 | 10/1921 | Dice | 248/150 |
| 2,115,242 | 4/1938 | Wagner et al. | 248/154 X |
| 2,509,284 | 5/1950 | Allen | 248/156 X |
| 2,945,662 | 7/1960 | Jennings | 248/354.3 X |
| 3,124,110 | 3/1964 | Buehl | 122/494 |
| 3,197,032 | 7/1965 | Stanley | 248/154 X |
| 3,786,606 | 1/1974 | Greoner et al. | 248/146 X |
| 3,805,988 | 4/1974 | Walker et al. | 248/146 X |
| 3,998,294 | 12/1976 | Moeller | 248/354.3 X |
| 4,955,573 | 9/1990 | Horvath | 248/313 |
| 5,085,387 | 2/1992 | Peterson et al. | 248/154 |
| 5,190,260 | 3/1993 | Daubenspeck | 248/313 |
| 5,199,676 | 4/1993 | Kowalewski | 248/149 |
| 5,398,897 | 3/1995 | Sverdlik | 248/146 X |
| 5,398,898 | 3/1995 | Bever | 248/311.2 X |

*Primary Examiner*—Leslie A. Braun
*Assistant Examiner*—Anita M. King
*Attorney, Agent, or Firm*—Feix & Feix

[57] ABSTRACT

A seismic support system for supporting and restraining a water heater against both horizontal and vertical displacement in the event of an earthquake. The seismic support system comprises three principle components including: a bracket assembly including primary length-adjustable bracing arms for bracing an upper perimeter portion of the water heater to a nearby wall or walls; an adjustable and collapsible stand assembly for elevating the water heater above a floor surface; and plural spaced apart vertically oriented connecting members which surround and cradle the water heater and join the water heater stand assembly to the bracket assembly. Secondary bracing members are also provided to the bracket assembly extending between the primary bracing arms and the wall and/or opposite ends of the primary bracing arms in cross member fashion to provide additional rigidity. The stand assembly includes height-adjustable foot members to adapt the stand assembly to uneven floor surfaces.

17 Claims, 6 Drawing Sheets

14
15
17
22
15
18
28
15
26
30
20
10
18
12
18
18
86
86
62
70
60
16
69
60
96
90
96
60
64
70
90
96
90

WATER HEATER SEISMIC SUPPORT SYSTEM

BACKGROUND OF THE INVENTION

1. Field of the Invention

The present invention relates to systems for supporting and restraining water heaters, boilers and other similar generally cylindrical appliances which have water and power supply lines that are subject to damage during seismic activity. More particularly, the invention relates to a water heater seismic support system including a collapsible water heater stand assembly and a bracket assembly for stabilizing the water heater against seismic-induced vertical and horizontal displacement in order to maintain the water and power connections to the water heater and thereby reduce the likelihood of fire, flooding and other damage which is known to occur during an earthquake.

2. Brief Description of the Prior Art

Water heaters, boilers and like appliances which generate a glow, spark or flame capable of igniting flammable vapors should be securely anchored or strapped in place in order to prevent horizontal and vertical displacement in the event of an earthquake. If the water heater, boiler, etc. is allowed to topple over, there is a likelihood that fire or flooding will occur.

Retro-fit water heater strap fasteners for use in securing an upper cylindrical portion of a water heater to an adjacent wall for restraining horizontal displacement of the water heater are known from the prior art.

For example, U.S. Pat. No. 5,190,260 issued to Daubenspeck discloses a water heater strap fastener system which includes two right triangular brackets which are positioned along opposite sides of the water heater. In use, the brackets are mounted directly to the studs in a nearby wall or on a beam which, in turn, is mounted to the studs in a nearby wall. An adjustable strap is then wrapped around the water heater and is connected to the wall mounted brackets.

U.S. Pat. No. 4,955,573 issued to Horvath discloses a three piece fastening system including: a first bracket piece for mounting to the studs in a nearby wall; a second piece in the form of a collar having an open cradle portion for receiving a wall facing perimeter portion of the water heater and two outwardly angled and rearwardly extended legs each having ends adapted for connection to the wall-mounted bracket piece; and a third strap piece which wraps around the remaining perimeter portion of the water heater in order to secure the water heater in place within the cradle portion. The opposite ends of the strap piece extend rearwardly a distance and are anchored to the first wall-mounted bracket piece.

A common disadvantage with each of the above described prior art fastening systems is the necessity of having to first mount a wooden beam or bracket piece that to the nearby wall before installing the strap or collar assembly. Often times these wall mountable brackets will not line up with the stud layout on the wall. Also, these types of brackets may fail to avoid obstacles, such as electrical conduit, plumbing, etc., which are frequently located on the wall behind the water heater.

In the past, seismic considerations were not of much concern and water heaters were installed at greater distances from the wall. In these situations, the brackets of the prior art will require that the water heater be reinstalled at a position closer in order to be effectively restrained from movement.

Further, in view of the relatively minimal adjustment capability between the wall and the water heater, such fastening systems are of limited use since they can only be used to brace water heaters which are positioned within a minimum specified distance from a nearby wall.

A desireable water heater bracing system should therefore permit flexibility when bracing the water heater to a nearby wall or walls and should be able to accommodate different stud spacings in the wall. The bracing system should also be length-adjustable in order to brace water heaters to one or more nearby walls which are located at a greater distances away from the installed position of the water heater. The need to avoid obstacles such as plumbing and electrical lines frequently located on the walls is another concern. A water heater bracing system which offers such flexibility would eliminate the need to reposition a water heater closer to a wall in order to properly secure it thereto and also would obviate the time and labor associated with the re-plumbing of the water connections to the water heater.

Stands for elevating a water heater above a floor level are known in the art. The Uniform Plumbing Code specifies that a water heater which is installed in a garage must be elevated such that the pilots, burners or like heating elements are at least 18 inches above ground level. The elevation will prevent a combustion event from occurring should flammable vapors be present. Some desireable features in a water heater stand include: rigidity and strength; quick knock down capability for compact storage during non-use (i.e., when packaging for retail sale); and the capability to permit quick size adjustment to accommodate water heaters of different diameters. An exemplary prior art water heater stand having the above desirable features is disclosed in U.S. Pat. No. 5,199,676 issued to Kowalewski.

A further desireable feature in a water heater stand would be the capability of fastening or anchoring the legs of the stand to an uneven floor surface such that the stand will still provide a horizontally level support for the water heater.

The water heater stands of the prior art generally do not function to effectively brace a water heater against displacement of any kind (ie. either horizontal or vertical displacement) in order to keep the water heater from toppling over in the event of an earthquake.

Accordingly, there is a definite need in the art for a water heater seismic support system including a water heater stand and a bracket assembly which when used in combination effectively restrain a water heater against both horizontal and vertical displacement. There is also a need in the art for a water heater stand and bracket assembly which respectively incorporate the above noted desirable features and which further overcome the problems of the respective prior art designs for the bracket assembly and stand.

SUMMARY OF THE INVENTION

Briefly, a preferred embodiment of the present invention comprises a seismic support system for supporting and restraining a water heater against both horizontal and vertical displacement in the event of an earthquake. The seismic support system comprises three principle components including: a bracket assembly for bracing an upper perimeter portion of the water heater to a nearby wall or walls; an adjustable and collapsible stand assembly for elevating the water heater above a floor surface; and plural spaced apart vertically oriented connecting members which surround the water heater and which extend between and join the water heater stand assembly to the bracket assembly.

The bracket assembly includes an adjustable strap and at least two length adjustable bracing members or arms which are pivotally and slidably connected to the adjustable strap. In use, the bracing arms are anchored to the studs located in a nearby wall using conventional mounting hardware such as bolt or screw fasteners. The length adjustment feature of the bracing arms and the pivot and slidable connection of the bracing arms to the strap permit a wide range of effective and rigid bracing configurations, irrespective of the relative distance of the water heater to the wall and the relative stud spacings in the wall.

The bracket assembly may advantageously include secondary bracing members in the form of length-adjustable linkages or cables which branch off of the primary bracing members to the wall or in cross fashion between the opposing ends of the primary bracing members to provide additional triangulated support structure to the bracket assembly. The bracket assembly may also include a mounting bar for mounting to the wall. The mounting bar is dividable into two lengths in order to avoid obstacles on the wall and advantageously includes numerous evenly spaced connection points such as holes or like structure which provide a greater range of flexibility for securing the primary and secondary bracing members to the wall in any desired angular fashion.

In another embodiment for the bracket assembly, a third length-adjustable bracing arm is provided. The three arm bracket assembly is especially suitable for use in bracing a water heater that is installed within a three wall enclosure, such as is commonly found in the closet spaces of newer homes, apartments, condominiums, town houses and businesses.

In accordance with a preferred embodiment, the stand assembly is made up of three vertically oriented leg supports which are connected together at a common vertical central axis to form a collapsible tripod support structure. The leg supports are joined together by panel assemblies which are width adjustable in order to accommodate water heaters of different sized diameters. A hub is provided to lock the hinge-connected leg supports in a desired tri-spoke configuration.

The respective outer edges of the panel assemblies are secured to a respective one of the vertically oriented leg supports. Each leg support has a bottom end portion provided with a height-adjustable foot member. The height-adjustable foot members can be independently adjusted in order to adapt the stand to an uneven floor surface and still support the water heater at a desired horizontally level position.

The vertically oriented connecting members extend upwardly from each of the respective outwardly disposed vertically oriented leg supports of the stand assembly and are joined at their upper ends to the adjustable strap of the bracket assembly. The upwardly extended connecting members are spaced about the perimeter of the water heater and advantageously provide added measure of restraint against both horizontal and vertical displacement of the water heater.

These and other objects and advantages of the present invention will no doubt become apparent to those skilled in the art from the following drawings, detailed description of the preferred embodiment and the appended claims.

IN THE DRAWING

FIG. 9 is an enlarged isometric view showing a first alternate embodiment for the height- and width-adjustable stand assembly of the present invention.

Figures 11, 12:
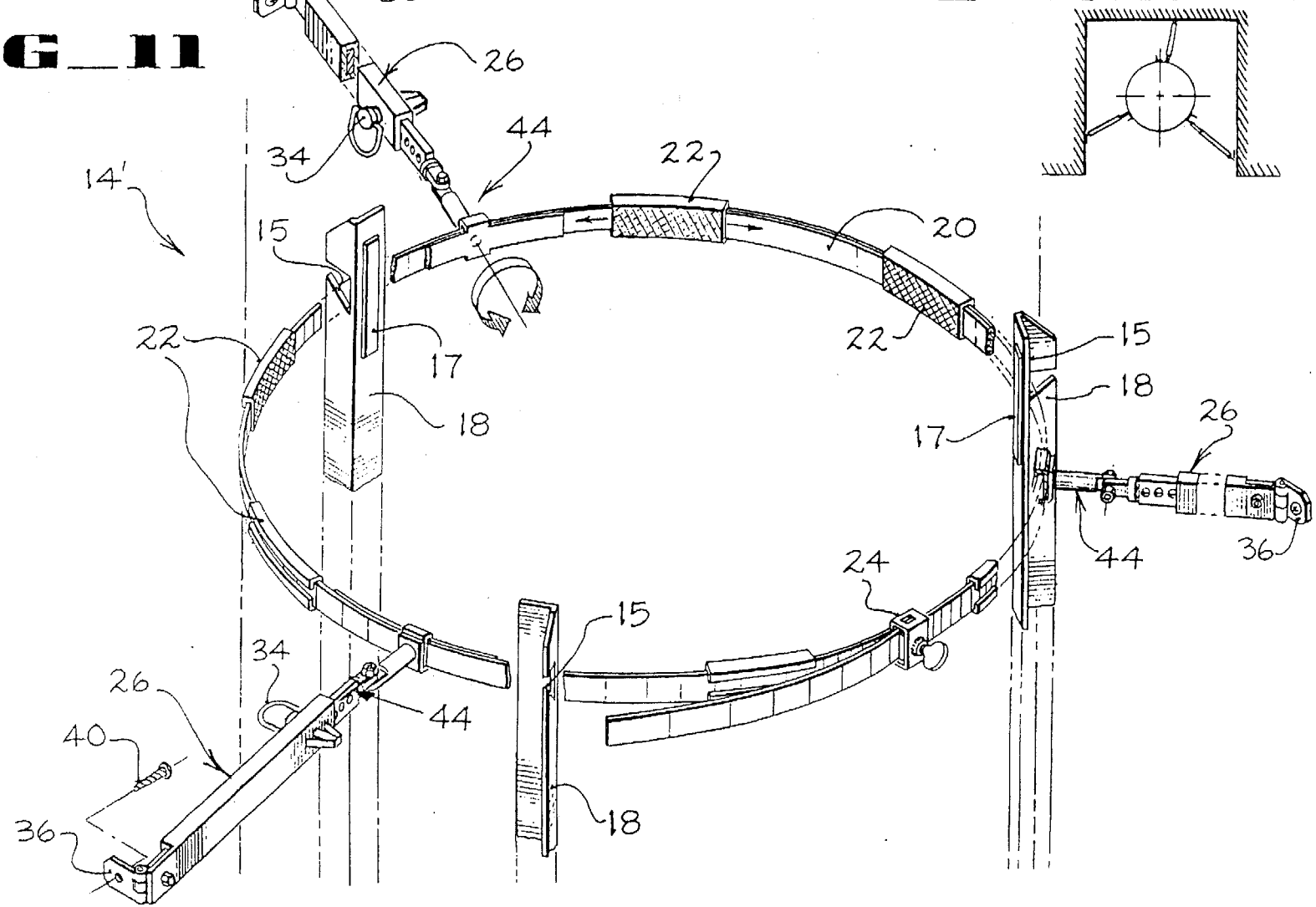

FIG. 11 an enlarged isometric view showing an alternate embodiment for the bracket assembly of the present invention as a tri-arm assembly for use in stabilizing a water heater installed within a three wall enclosure.

FIG. 12 is a schematic top plan view depicting a water heater installed within a three wall enclosure and being secured to each of the three walls by a respective arm or bracing member of the tri-arm bracket assembly of FIG. 11.

DESCRIPTION OF THE PREFERRED EMBODIMENT

The following detailed description illustrates the invention by way of example, not by way of limitation of the principles of the invention. This description will clearly enable one skilled in the art to make and use the invention, and describes several embodiments, adaptations, variations, alternatives and uses of the invention, including what we presently believe is the best mode of carrying out the invention.

Figure 1:
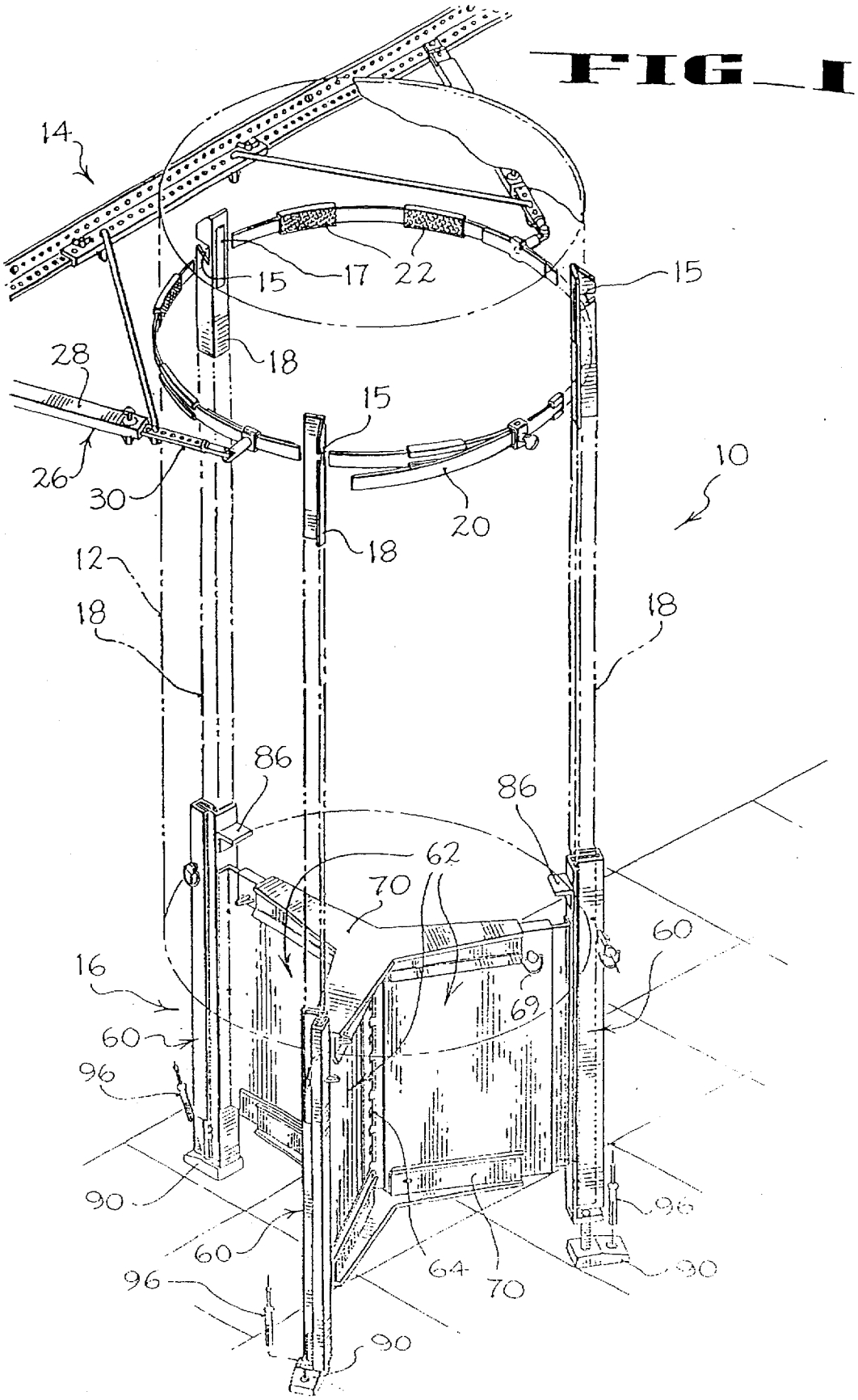
FIG. 1 is an isometric view of a seismic support system for a water heater (shown in phantom) constructed in accordance with the present invention.

A water heater seismic support system constructed in accordance with one embodiment of the present invention is indicated generally by the reference numeral 10 in FIG. 1. The water heater seismic support system 10 is shown supporting a water heater 12 (indicated in phantom).

The water heater seismic support system 10 secures the water heater 12 to its surrounding structure (ie. the floor and any nearby wall or walls) and will resist vertical and horizontal displacement of the water heater 10 in the event of an earthquake. If left unrestrained, the water heater 10 may topple over. This may result in damage to the water and power supply lines and to the glo-, flame- or spark-igniting heating elements of the water heater which, in turn, can cause flooding and fire, respectively.

The water heater seismic support system 10 comprises three principle components or assemblies including a bracket assembly 14, a stand assembly 16 and plural extension or connecting members 18 which extend between and rigidly secure the bracket assembly 14 to the stand assembly 16.

Figures 2, 3:
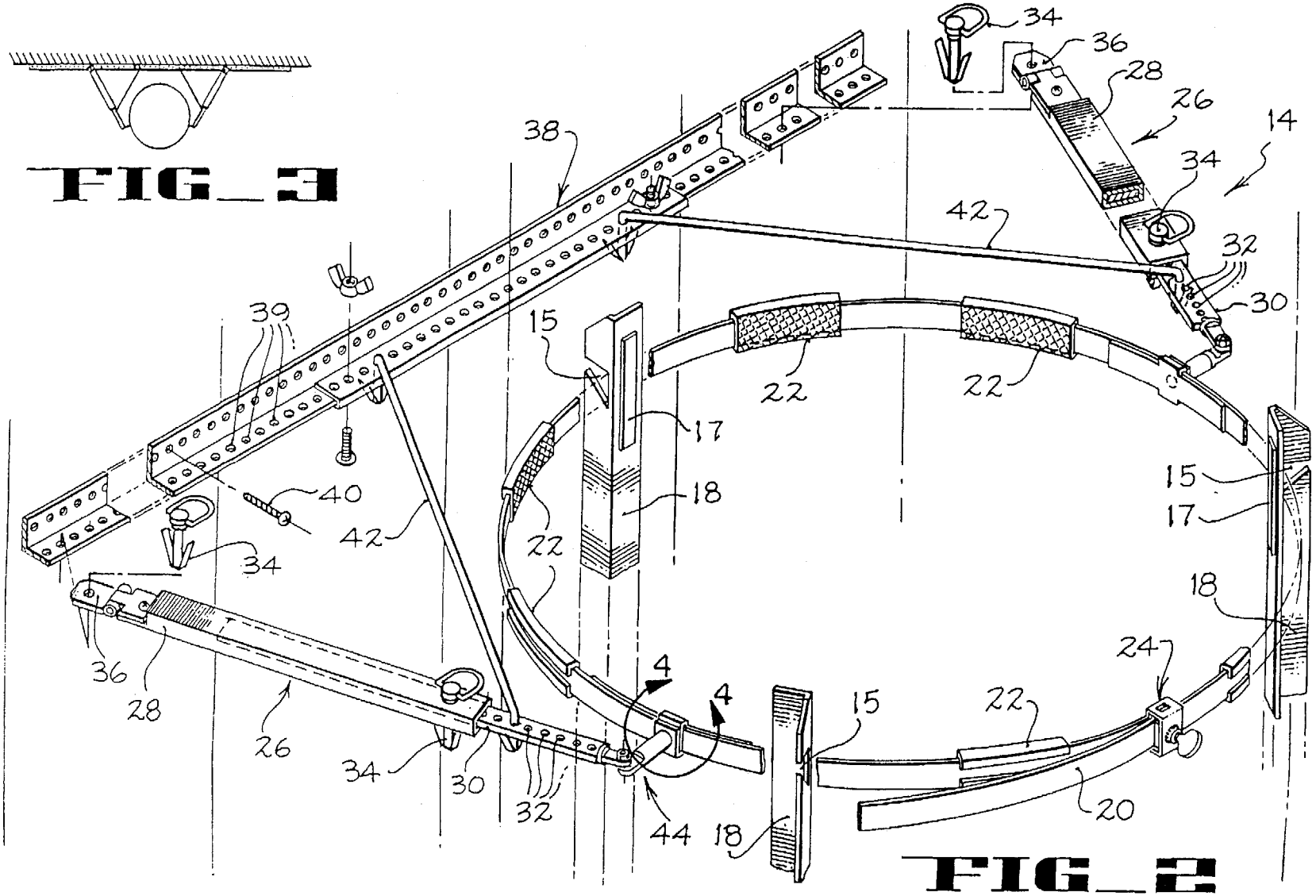
FIG. 2 is an enlarged isometric view of the dual arm water heater bracket assembly shown in FIG. 1.
FIG. 3 is a schematic top plan view depicting a water heater being secured to an adjacent wall by the dual arm bracket assembly of FIG. 2.

As best seen in FIGS. 1–2, the bracket assembly 14 includes an adjustable strap 20 which fits around the perimeter of the water heater 12. The strap 20 is preferably provided with a rubber liner means for improving the grip of the strap 20 about the water heater 12 and for protecting the finish of the water heater 12. In the preferred embodiment, the rubber liner means comprises plural removable clip on members 22 in the form of thermoformed plastic members, C-shape in cross section, and which have a rubber or other suitable foam padding material disposed thereon. The clip on members 22 may be slidably positioned along the length of the strap 20. In use, the strap is cinched tight and held in place by a locking screw 24.

The bracket assembly 14 further includes primary bracing members or arms 26 for connecting the adjustable strap 20 to a nearby wall. The primary bracing arms 26 are preferably length-adjustable in order to accommodate and effectively brace water heaters which are installed at varying distances from a nearby wall. For example, in some cases a water heater, may by necessity, be located at more than a foot away from the nearest wall due to the presence of electrical conduit or heating ducts disposed between the wall and the water heater or due to the offset resulting from a sloped foundation at the bottom of the wall which prevents the base of the water heater or water heater stand from being positioned any closer to the wall.

As best seen in FIG. 2, each length-adjustable primary bracing arms 26 is in the form of a telescoping member which includes a hollow body portion 28 and a extension member 30. The extension member 30 is perforated with a plurality of regularly spaced through-holes 32 and is held in place with respect to the hollow body portion 28 by a conventional spring-type locking pin 34. The base end of the hollow body portion 28 is provided with a pivoting hinge 36 for connection to a nearby wall either directly, or as is the case for the embodiment shown, to a bracket mounting bar 38. The bracket mounting bar 38, in turn, is mounted to the wall by screws 40 (only one of which is shown for purposes of clarity). Preferred screws 40 would include self-tapping Phillips or hex head screws that permit use of Phillips screw drivers or socket wrenches for easy and quick installation. Of course, other conventional wall fasteners may also be used with equally good results.

The bracket mounting bar 38 allows the length-adjustable primary bracing arms 26 to be mounted at any desired angle from the water heater to the wall irrespective of the stud spacing in the nearby wall relative to the position of the water heater. The bracket mounting bar 38 is preferably composed of angle iron and is preferably dividable into two pieces for compact packing. In the event that obstacles are in the way (ie, electrical conduit or other fixtures), the bracket mounting bar 38 can be separated or divided into two pieces and mounted to the wall along either side of the obstacle.

The bracket mounting bar 38 is preferably perforated with a plurality of regular spaced through-holes 39 sized for receiving locking pins 34 which permit the pinned connection with the length-adjustable primary bracing arms 26 and which also permit the pinned connection with secondary bracing members 42.

The secondary bracing arms 42 may be added and mounted between the bracket mounting bar 38 and the primary bracing arms 26 to provide additional rigidity to the bracket assembly 14. When used in this manner, the secondary bracing arms 42 prevent flexing of the primary bracing arms 26 and thereby provide an increase to the overall strength and rigidity of the bracket assembly 14. The secondary bracing arms 42 when installed also decrease lateral movement of the water heater. The secondary bracing arms preferably comprise ¼" steel rod having 90 degree bends at each end for hook-type engagement with the through-holes 32 and 39 of the perforated extension members 30 and perforated bracket mounting bar 38, respectively.

One configuration for a sturdy and rigid connection of a water heater to a nearby wall using the bracket assembly 14 of the present invention is shown schematically in FIG. 3.

Figure 4:
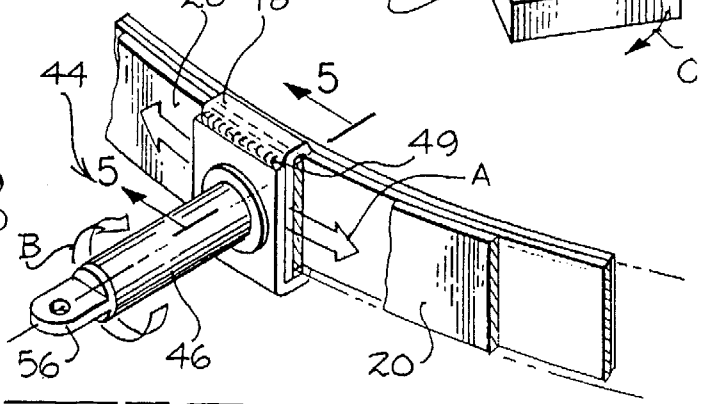
FIG. 4 is an enlarged fragmentary isometric view of the sliding swivel joint and adjustable strap region shown encircled by double arrow 4—4 of FIG. 2.

Sliding swivel connectors 44 are used for connecting the free ends of the perforated extension members 30 of the length-adjustable primary bracing arms 26 to the adjustable strap 20. The construction detail of the sliding swivel connector 44 of the present invention is best seen with reference to FIGS. 4–5.

Figure 5:
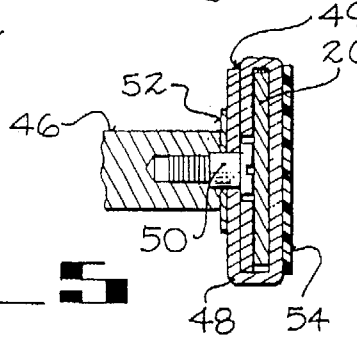
FIG. 5 is a side elevation view in partial cross section taken along the line and in the direction of arrows 5—5 of FIG. 4.

The sliding swivel connectors 44 allow the length-adjustable primary bracing arms 26 to swing in any position, up or down, left or right, with respect to the adjustable strap 20. Each sliding swivel connector 44 consists of a barrel portion 46 which is swivel connected to a sleeve-like base portion 48. The sleeve-like base portion 48 is originally formed as a flat metal plate that is folded along its length at four points to form a slidable sleeve enclosure about the adjustable strap 20 (see eg. FIG. 5). The sleeve-like base portion 48 is held together in a close tolerance fit about the strap 20 by a weld seam 49 and can slide left to right along the adjustable strap 20 as indicated by direction arrow A.

As best seen in FIG. 5, the swivel connection between the barrel portion 46 and the sleeve-like base portion 48 is provided by axial screw fastener 50 and bearing member 52. The axial screw fastener 50 and bearing member 52 allow the barrel portion 46 to swivel or rotate in the direction as indicated by arrow B. The inward facing surface of the sleeve-like base portion 48 (ie. the surface facing the water heater) is also provided with a rubber liner 54 to provide additional grip for engaging the water heater 12. The free end 56 of the barrel portion 46 is flattened and drilled with a hole. In use, this end 56 is pinned to the free end of the perforated extension member 30. As is readily apparent from the drawings, this pinned connection in combination with the sliding movement of the sleeve-like base portion 48 (arrow A) and the swivel movement of the barrel portion 46 (arrow B) affords great flexibility in setting up useful and sturdy bracing configurations of the bracket assembly 14.

In the preferred embodiment, the adjustable strap 20 is further restrained against vertical displacement by engagement within the downwardly sloped slots 15 provided in the upwardly extending connecting members 18. The inward facing surface of the connecting members 18 are also preferably provided with rubber liners 17 which facilitate the water heater gripping action of the foam padded or rubber-lined clip on members 22 and the inwardly disposed rubber liners 54 of the sliding swivel connectors 44. Alternatively, the bracket assembly 14 may be used separately from the stand assembly 16 and connecting members 18 for retrofitting and bracing existing water heaters with or without a water heater stand.

With reference to FIGS. 1, 6, 7 and 8, the water heater stand assembly 16 will now be described. The water heater stand assembly 16 comprises three vertically oriented frame members or leg supports 60 arranged in a tripod configuration about a common vertical center axis that is aligned substantially coordinate with a center axis of the water heater 12 being supported by the stand assembly 16.

Figure 6:
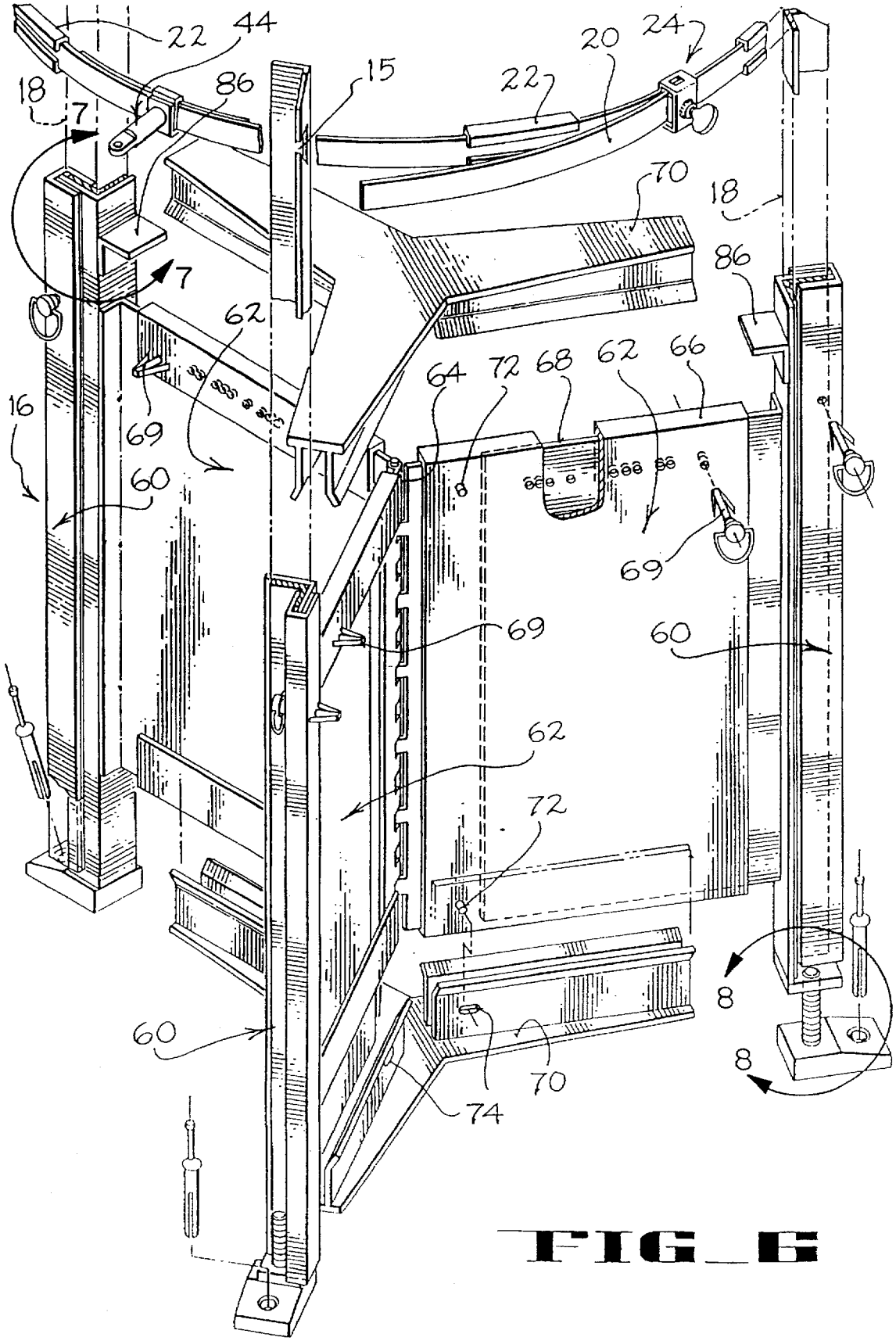
FIG. 6 is an enlarged isometric view showing the height- and width-adjustable water heater stand assembly of FIG. 1.

Each leg support 60 has associated therewith a width-adjustable panel assembly 62. The panel assemblies 62 are all joined together at the common vertical center axis by a tri-hinge member 64. Each panel assembly 62 includes two panel pieces including a first panel piece 66 firmly connected to the tri-hinge member and a second panel piece 68 firmly connected to its respective leg support. The first panel piece 66 is generally c-shaped in cross section and the second panel piece 68 is adapted for slidable engagement within the c-shaped interior structure of the first panel piece 66 over a range of inserted depths by means of a removable locking pin 69. The locking pin 69 is inserted within co-aligned holes provided in the first and second panel pieces 66, 68 (see eg. FIG. 6). To adjust the stand assembly to water heaters of different diameters, the locking pins 69 are removed from each panel assembly 62 and the desired width of the panel assembly 62 is attained by sliding the second panel piece 68 in or out with respect to the first panel piece 66. The holes of the first and second panel pieces are then re-aligned and the locking pins 69 are re-inserted to complete the adjustment.

The above described tri-hinge panel assembly allows the stand to collapse for compact packaging and is constructed to facilitate quick installation and size adjustment with a minimum of tools or skill required. The tri-hinge panel assembly is locked into the desired tri-pod configuration by use of at least one and preferably two, locking hub members 70. Each locking hub member 70 is adapted to engage the top and/or bottom edges of the tri-hinge panel assembly in snap-fit fashion. Each panel piece 66 is further provided with studs 72 located adjacent the top and bottom edges thereof. In practice, the studs 72 are aligned with a respective slot 74 provided in the locking hubs 70 in order to lock the locking hubs 70 in place onto the top and/or bottom edges of the tri-hinge panel assembly (see FIG. 6).

Figure 7:
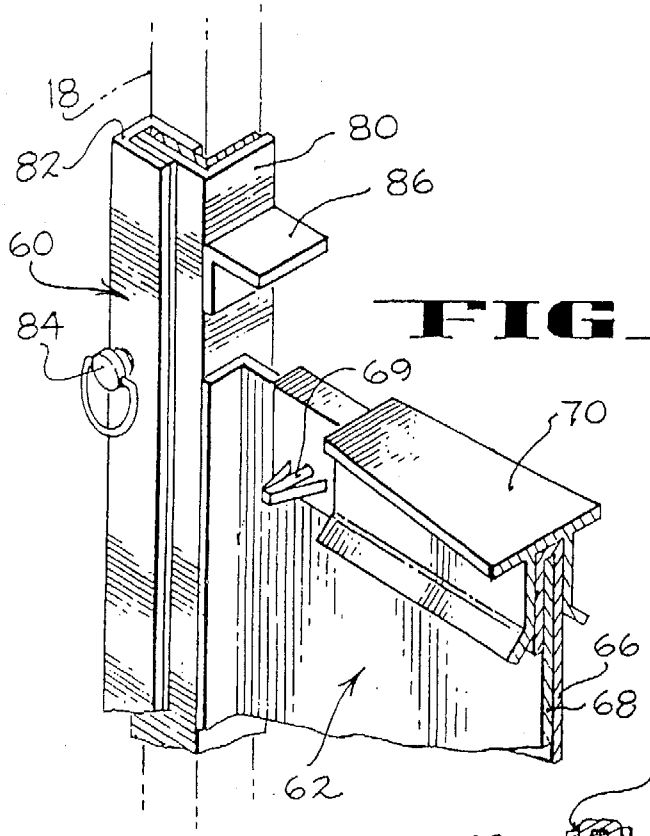
FIG. 7 is an enlarged fragmentary isometric view of the upper corner panel and vertically oriented leg support region of the stand shown encircled by double arrow 7—7 of FIG. 6.

As best seen in FIG. 7, the leg supports 60 are also advantageously constructed to receivingly engage the bottom end portions of the connecting members 18. In the preferred embodiment, each leg support 60 consists of two parts including an inner L-section member 80 and an outer U-section member 82. The U-section member 82 has a sufficient gap width spacing to receive a wall thickness portion of the L-section member 80 and a wall thickness portion of a respective connecting member 18. The three structural elements 18, 80 and 82 are held locked in place by a removable pin 84 which is inserted within co-aligned through-holes provided in each of the three structural elements 18, 80 and 82. The base of the water heater is supported by radially inwardly extending L-shaped base mounts 86 provided to the upper end portion of each inner L-section member 80 of each leg support 60.

In addition to providing a convenient means for connecting the bracket assembly 14 to the stand assembly 16, the connecting members 18 also help cradle the water heater 12 along three sides and thereby prevent the water heater 12 from slipping off the stand assembly 14 at the base when lateral or horizontal movement occurs. The connecting members 18 also function to resist vertical displacement of the water heater 12 when ground tremblers occur.

Figure 8:
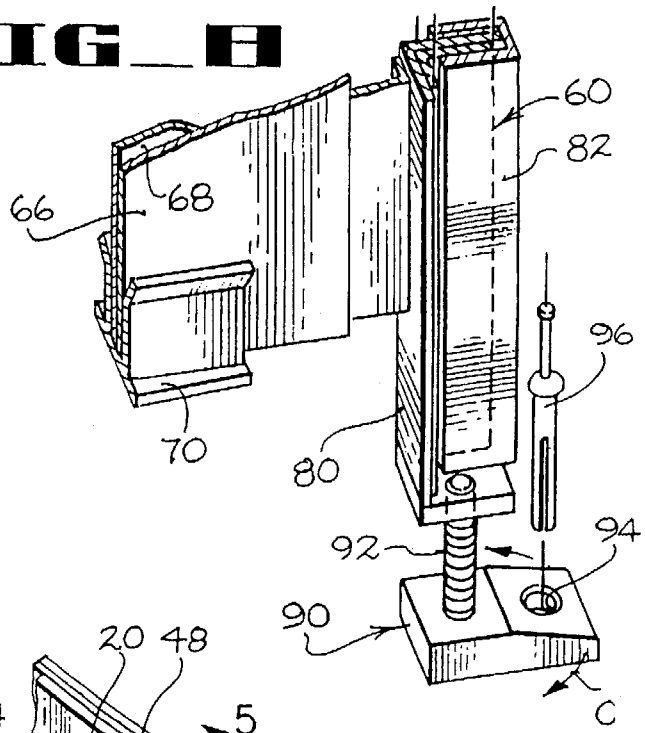

As best seen in FIG. 8, the stand assembly 14 is advantageously adaptable to uneven floor surfaces by the provision of height-adjustable foot members 90 to the bottom end portion of each leg support 60. Each foot member 90 of each leg support 60 includes a threaded stud portion 92 which, when rotated in accordance with the direction of double arrow C, will move the foot member 90 up or down with respect to the leg support 60. Each foot member 90 further includes a through-hole 94 sized for receiving a fastener therethrough in order to fasten or anchor the stand assembly 14 to a floor surface. In the embodiment shown and described in the drawings, concrete fasteners 96 are used to anchor the stand assembly 16 to a concrete slab foundation. For certain limited floor space situations, the laterally extended portion of each foot member 90 may be rotated inwardly to permit closer positioning of the stand assembly 16 to a nearby wall.

DESCRIPTION OF ALTERNATE EMBODIMENTS

The water heater stand assembly may also be constructed in a variety of ways to conform to and provide seismic support and stabilization for various other objects, including but not limited to computers, air conditioners, tanks or containers that contain chemicals and gasses, liquid or solids, explosives, or fragile items. Also, other objects which have electrical, gas, water, or any other supply connection that may become damaged during a seismic movement or any other source of movement may be supported and stabilized against vertical and horizontal displacement by the seismic support system of the present invention.

The following description illustrates some possible alternate embodiments for the major components of the seismic support system of the present invention. Structural elements which are common to both the preferred embodiment and the various alternate embodiments are designated with the reference numerals as used previously in the description of the preferred embodiment.

Figure 9:
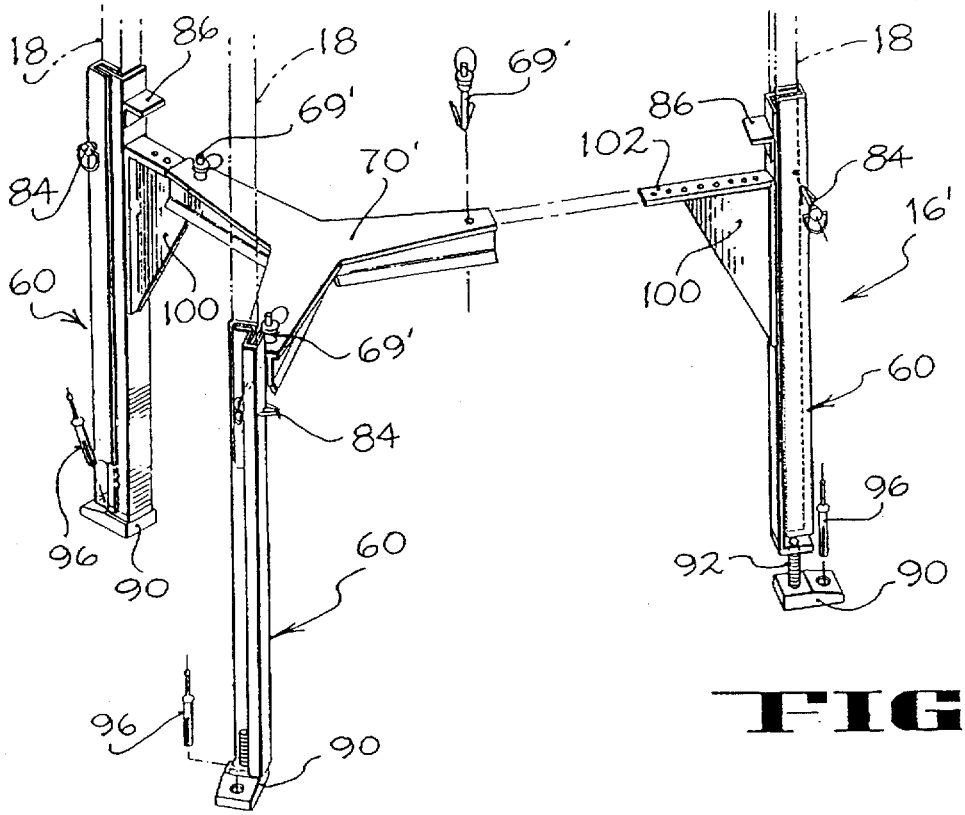
FIG. 9 is an enlarged fragmentary isometric view of the height-adjustable foot region of the stand shown encircled by double arrow 8—8 of FIG. 6.

FIG. 9 shows a first alternate embodiment for the stand assembly of the present invention and is designated generally by the reference numeral 16'. In this embodiment, a single tri-arm hub 70' is used to join the three leg supports 60 together. Each leg support 60 has attached thereto a ninety degree angle member 100 having an extended bar portion 102 provided along an upper surface thereof. The extended bar portion 102 includes a plurality of spaced through-holes. Each arm or extension of the tri-arm hub 70' defines a receiving cavity for receivingly engaging the free end of the respective extended bar portion 102 of each angle member 100. Each arm or extension of the tri-arm hub 70' is also provided with a hole which, during an installation or adjustment, is aligned with one of the holes of the bar portion 102 so that a removable locking pin 69' can be inserted therethrough in order to complete the assembly.

Figure 10:
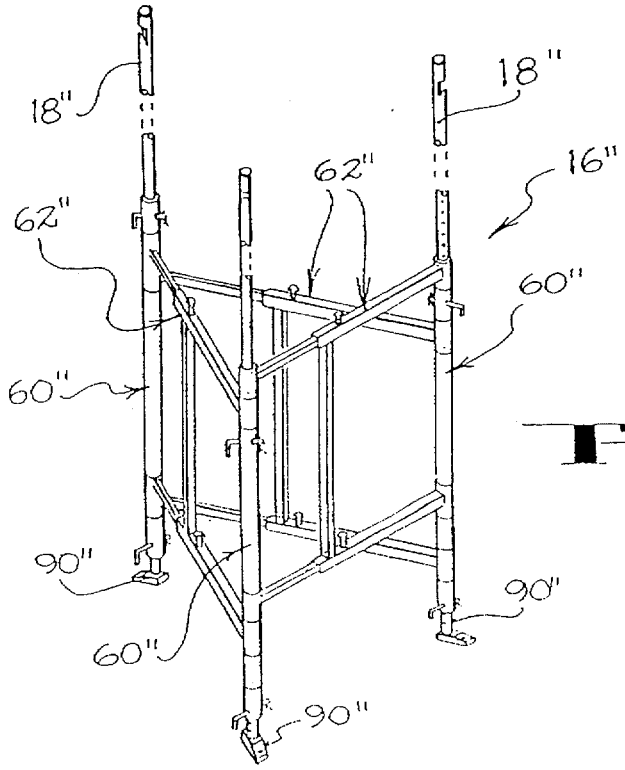
FIG. 10 is an reduced isometric view showing a second alternate embodiment for the height- and width-adjustable stand assembly of the present invention.

FIG. 10 shows a second alternate embodiment for the stand assembly of the present invention and is designated generally by the reference numeral 16". In this embodiment, width-adjustable panel assemblies 62", each in the form of open rectangular framework, are used to connect the leg supports 60" in a generally triangular fashion. The leg supports 60" are shown as generally tubular members each having an upper end adapted for receivingly engaging a respective tubular connecting member 18" (which, in turn, may be connected at its upper end to the adjustable strap of the bracket assembly) and a lower end adapted for receivingly engaging a height-adjustable foot member 90". As before, base mount structure (not shown) may be provided to the upper inwardly facing portion of each leg support 60" in order to support the base or bottom end portion of the water heater other object to be supported and stabilized against vertical and horizontal displacement.

FIG. 11 shows an alternate embodiment for the bracket assembly 14' of the present invention. In this embodiment, the bracket assembly 14' includes an additional length-adjustable primary bracing arm 26 to define a tri-arm bracket assembly. The tri-arm embodiment of FIG. 11 is substantially the same as the dual arm embodiment shown in FIG. 2 except that the tri-arm embodiment does not require a separate wall-mounted bracket mounting bar for use in securing the bracing arms 26 to the wall. The tri-arm embodiment is particularly useful for securing and stabilizing a water heater or like object which is to be installed within a three wall enclosure, as is the common practice in newer homes, condominiums, town homes, businesses and apartment units. The hinge and sliding swivel connections to the bracing arms 26 as well as the length adjustment capability of the bracing arms 26 permit great flexibility in stabilizing a water heater within a three wall enclosure irrespective of the stud locations in the adjacent walls.

An exemplary bracing configuration for stabilizing a water heater within a three wall enclosure using the tri-arm bracket assembly 14' of the present invention is shown schematically in FIG. 12.

It should be understood that various modifications within the scope of this invention can be made by one of ordinary skill in the art without departing from the spirit thereof. We therefore wish our invention to be defined by the scope of the appended claims as broadly as the prior art will permit, and in view of the specification if need be.

PARTS LIST

10. Seismic Water Heater Support System
12. Water Heater
14. Bracket Assembly
16. Stand Assembly
18. Connecting Member
20. Adjustable Strap
22. Clip on Members
24. Locking Screw
26. Primary Bracing Arms
28. Hollow Body Portion
30. Perforated Extension
32. Through-holes
34. Locking Pin
36. Pivoting Hinge
38. Bracket Mounting Bar
39. Through-holes
40. Screws
42. Secondary Bracing Members
44. Sliding Swivel Connector
46. Barrel Portion
48. Sleeve-like Base Portion
49. Weld Seam
50. Axial Screw
52. Bearing member
54. Rubber liner
60. Leg Support
62. Panel Assembly
64. Tri-Hinge Member
66. First Panel Piece
68. Second Panel Piece
69. Locking Pin
70. Locking Hub
72. Stud
74. Slot
80. L-Section Member
82. U-Section Member
84. Pin
86. L-Shaped Base Mount
90. Foot Members
92. Threaded Stud
94. Through-hole
96. Concrete Fastener
100. 90° Angle Member
102. Bar Portion

What is claimed is:

1. A seismic support system for stabilizing a glow-, spark- or flame-generating water heater positioned near a wall and for preventing both vertical and horizontal displacement of the water heater due to earthquake motion, said seismic support system comprising in operative combination:

a) a stand assembly for supporting a bottom end portion of a water heater and for elevating said bottom end portion and associated flame-ignitable heating elements at a specified vertical height distance above floor level, said stand assembly including:

i) three vertically oriented leg supports arranged in a tripod configuration about a common vertical center axis, said common vertical center axis being aligned substantially coordinate with a center axis of a water heater, each of said leg supports having an upper end portion and a lower end portion;

ii) frame means for interconnecting said three leg supports to each other, said frame means is adjustable such that the leg supports can be selectively positioned at desired lateral distances from said common center axis in order to accommodate water heaters of varying diameters; said frame means is movable between a first, compactly folded stowed position and a second, use position, and wherein said frame means further includes: three vertically oriented width-adjustable panel assemblies each having a top edge, a bottom edge, a first inner side edge and a second outer side edge; a hinge assembly connecting said three panel assemblies to one another along their respective first inner side edges to define a tri-spoke configuration when moved into said second, use position; and hub means constructed to engage each of said panel assemblies for locking said panel assemblies into said second, use position;

iii) each of said leg supports including vertical height adjustment means comprising a foot member that is swivel connected by a threaded stud and plate connector to the lower end portion of each leg support, said vertical height adjustment means operative to adapt the stand assembly to uneven floor surfaces while maintaining said water heater in a desired horizontally level support position, each foot member including a vertical through-hole;

iv) fastener means comprising a floor piercing fastener sized for receiving engagement within said hole of each foot member for fastening to a floor surface;

b) bracket means for restraining horizontal displacement of said water heater, said bracket means including:

i) an adjustable strap assembly adapted to engage the upper portion of said water heater;

ii) primary bracing means for bracing the adjustable strap assembly to a nearby wall; and c) extension means for rigidly connecting said strap assembly to said leg supports of said stand assembly and thereby cradle said water heater and restrain vertical displacement of said water heater when supported and elevated by said stand assembly and horizontally restrained by said bracket means.

2. The seismic support system of claim 1 wherein said bracket means includes:

a) a horizontally oriented mounting bar assembly for mounting to a nearby wall adjacent the upper portion of said water heater, said mounting bar having a plurality of connector locations adapted to permit dis-connectable connection with said bracing means; and b) said bracing means comprise at least two length adjustable primary bracing arms disposed on opposed sides of said water heater, each of said length-adjustable primary bracing arms including a first end having a sliding, swivel connector connected to said adjustable strap assembly and a second end dis-connectably connected to said mounting bar.

3. The seismic support system of claim 2 wherein said bracket means further includes secondary bracing members for increasing rigidity of said primary bracing arms, each of said secondary bracing members having a first end connected to a middle portion of respective one of said primary bracing arms and a second end connected to one of said mounting bar or to a far end of an adjacent primary bracing arm in cross member fashion.

4. The seismic support system of claim 3 wherein said adjustable strap of said bracket means further includes padding means disposed facing said water heater for ensuring a firm grip engagement between the adjustable strap and said water heater as the adjustable strap is cinched tight about said water heater.

5. The seismic support system of claim 1 wherein said primary bracing means of said bracket means include three length-adjustable primary bracing arms disposed spaced substantially equidistant from one another about a periphery of said water heater, each of said length-adjustable primary bracing arm including a first end having a sliding, swivel connector connected to said adjustable strap assembly and a second end connected to a respective wall of a three wall enclosure.

6. The seismic support system of claim 5 wherein said adjustable strap of said bracket means further includes padding means disposed facing said water heater for ensuring a firm grip engagement between the adjustable strap and said water heater as the adjustable strap is cinched tight about said water heater.

7. A seismic support system for stabilizing a glow-, spark- or flame-generating water heater located near a wall and for preventing both vertical and horizontal displacement of the water heater due to earthquake motion, said seismic support system comprising in operative combination:

a) a stand assembly for supporting a bottom end portion of a water heater and for elevating said bottom end portion and associated flame-ignitable heating elements at a specified vertical height distance above floor level, said stand assembly including:

i) three vertically oriented leg supports arranged in a tripod configuration about a common vertical center axis, said common vertical center axis being aligned substantially coordinate with a center axis of a water heater, each of said leg supports having an upper end portion and a lower end portion;

ii) a tri-panel frame assembly for interconnecting said three leg supports to each other, said tri-panel frame assembly is adjustable such that the leg supports can be selectively positioned at desired lateral distances from said common center axis in order to accommodate water heaters of varying diameters; said tri-panel frame assembly is collapsible between a first, compactly folded stowed position and a second, use position, and wherein said tri-panel frame assembly further includes: three vertically oriented width-adjustable panel assemblies each having a top edge, a bottom edge, a first inner side edge and a second outer side edge; a hinge assembly connecting said three panel assemblies to one another along their respective first inner side edges to define a tri-spoke configuration when moved into said second, use position; and at least one locking hub constructed to engage each of said panel assemblies for locking said panel assemblies into said use position;

iii) the respective bottom end portion of each of said leg supports includes a height-adjustable foot member constructed to permit the stand assembly to adapt to uneven floor surfaces and still maintain said water heater at a desired horizontally level support position; each of said height-adjustable foot members is swivel connected to the lower end portion of a respective leg support and is provided with a vertical through-hole;

iv) a plurality of floor piercing fasteners sized for receiving engagement within said hole of each foot member for fastening the respective foot member to a floor surface;

b) a bracket assembly for restraining horizontal displacement of said water heater, said bracket assembly including:

i) an adjustable strap adapted to engage an upper perimeter portion of said water heater;

ii) a plurality of bracing arms disposed about a periphery of said water heater and disposed connecting the adjustable strap to a nearby wall; and c) a plurality of extension members, each having a lower end portion adjustably connected to a respective upper end portion of said leg supports, and an upper end portion connected to said adjustable strap, said extension members being effective to restrain vertical displacement of said water heater when said water heater is supported and elevated by said stand assembly and horizontally restrained by said bracket assembly.

8. The seismic support system of claim 7 wherein said bracket assembly further includes:

a) a horizontally oriented mounting bar for mounting to a nearby wall adjacent the upper portion of said water heater, said mounting bar having a plurality of connector locations adapted to permit dis-connectable connection with said primary bracing arms: and b) said plurality of bracing arms includes two length-adjustable primary bracing arms disposed on opposed sides of said water heater, said primary bracing arms, each including a first end having a sliding, swivel connector connected to said adjustable strap assembly and a second end dis-connectably connected to said mounting bar.

9. The seismic support system of claim 8 wherein said bracket assembly further includes secondary bracing arms disposed connecting a middle portion of each of said primary bracing arms to said mounting bar to define a triangulated support structure for increased rigidity.

10. The seismic support system of claim 9 wherein said adjustable strap of said bracket assembly further includes padding material disposed facing the water heater for ensuring a firm grip engagement between the adjustable strap and the water heater as the adjustable strap is cinched tight about the water heater.

11. The seismic support system of claim 7 wherein said plurality of bracing arms of said bracket means include three length-adjustable primary bracing arms disposed spaced substantially equidistant from one another about a periphery of said water heater, each of said length-adjustable primary bracing arms including a first end including a sliding, swivel connector connected to said adjustable strap assembly and a second end connected to a respective wall of a three wall enclosure.

12. The seismic support system of claim 11 wherein said adjustable strap of said bracket assembly further includes padding material disposed facing said water heater for ensuring a firm grip engagement between the adjustable strap and said water heater as the adjustable strap is cinched tight about said water heater.

13. A bracket assembly for stabilizing a glow-, spark- or flame-generating water heater located near a wall and for restraining and preventing displacement of the water heater due to earthquake motion, the bracket assembly comprising in operative combination:

a) an adjustable strap adapted to engage a perimeter portion of a water heater; and b) a plurality of primary bracing arms disposed about a periphery of said adjustable strap for bracing the adjustable strap to a nearby wall;

c) each of said primary bracing arms includes:

i) a first sliding, swivel connector end which is slidably connected to said adjustable strap;

ii) a second hinged connector end which is connected to the nearby wall; and d) each of said primary bracing arms are length-adjustable in order to provide a desired angle of attachment from the adjustable strap to the nearby wall irrespective of stud location in the nearby wall.

14. The bracket assembly of claim 13 which further includes a generally horizontally oriented mounting bar for mounting to the nearby wall adjacent the upper portion of said water heater, said mounting bar having a plurality of connector locations adapted to permit dis-connectable connection with said hinged connector end of said primary bracing arms.

15. The bracket assembly of claim 14 which further includes secondary bracing members for increasing rigidity of said primary bracing arms, each of said secondary bracing members having a first end connected to a middle portion of respective one of said primary bracing arms and a second end connected to one of said mounting bar or to a far end of an adjacent primary bracing arm in cross member fashion.

16. The bracket assembly of claim 13 which further includes secondary bracing members for increasing rigidity of said primary bracing arms, each of said secondary bracing members having a first end connected to a middle portion of respective one of said primary bracing arms and a second end connected to a far end of an adjacent primary bracing arm in cross member fashion.

17. A stand assembly for supporting a bottom end portion of a water heater and for elevating the water heater bottom end portion and associated flame-ignitable heating elements of the water heater at a specified vertical height distance above floor level, the water heater stand assembly comprising:

a) three vertically oriented leg supports arranged in a tripod configuration about a common vertical center axis, said common vertical center axis being aligned substantially coordinate with a center axis of a water heater, each of said leg supports having an upper end portion and a lower end portion, said upper end portion of each of said leg supports including connection means for receivingly engaging an extension member for connection to a water heater strap assembly;

b) frame means for interconnecting said three leg supports to each other, said frame means is movable between a first, compactly folded stowed position and a second, use position, and wherein said frame means further includes:

i) three vertically oriented width-adjustable panel assemblies each having a top edge, a bottom edge, a first inner side edge and a second outer side edge;

ii) a hinge assembly connecting said three panel assemblies to one another along their respective first inner side edges to define a tri-spoke configuration when moved into said second, use position; and iii) hub means constructed to engage each of said panel assemblies for locking said panel assemblies into said second, use position;

c) each of said leg supports including vertical height adjustment means constructed to adapt the stand assembly to uneven floor surfaces while maintaining said water heater in a desired horizontally level support position; and d) fastener means for fastening the respective lower end portions of each of said leg supports to a floor surface.

* * * * *